United States Patent [19]

Doehlert

[11] 4,159,897

[45] Jul. 3, 1979

[54] PRODUCING FLUID FUEL FROM COAL

[75] Inventor: David H. Doehlert, Earleville, Md.

[73] Assignee: Fluid Coal Corporation, Wilmington, Del.

[21] Appl. No.: 841,831

[22] Filed: Oct. 13, 1977

[51] Int. Cl.[2] ..... C10L 9/10; C10L 1/32; C10G 1/100

[52] U.S. Cl. ..... 44/51; 44/1 R; 208/8 LE

[58] Field of Search ..... 44/1 B, 1 E, 1 R, 51; 208/8

[56] References Cited

U.S. PATENT DOCUMENTS

| | | | |
|---|---|---|---|
| 3,932,145 | 1/1976 | Foulke | 44/1 R |
| 3,974,073 | 8/1976 | Sze et al. | 208/8 X |
| 4,035,281 | 7/1977 | Espenscheid et al. | 208/8 |

*Primary Examiner*—Carl Dees

*Attorney, Agent, or Firm*—George A. Smith, Jr.

[57] ABSTRACT

In a coal liquefaction system, product B.T.U./hr. can be significantly increased by dividing the coal to be treated into two portions, liquefying one portion, and adding the other portion to the product of the liquefaction process to produce a suspension for use as a fuel. The process is carried out by adding conventionally available equipment to a coal liquefaction plant, and the total plant is far less expensive to build and operate than a conventional liquefaction plant having the same production in terms of product B.T.U./hr.

6 Claims, 1 Drawing Figure

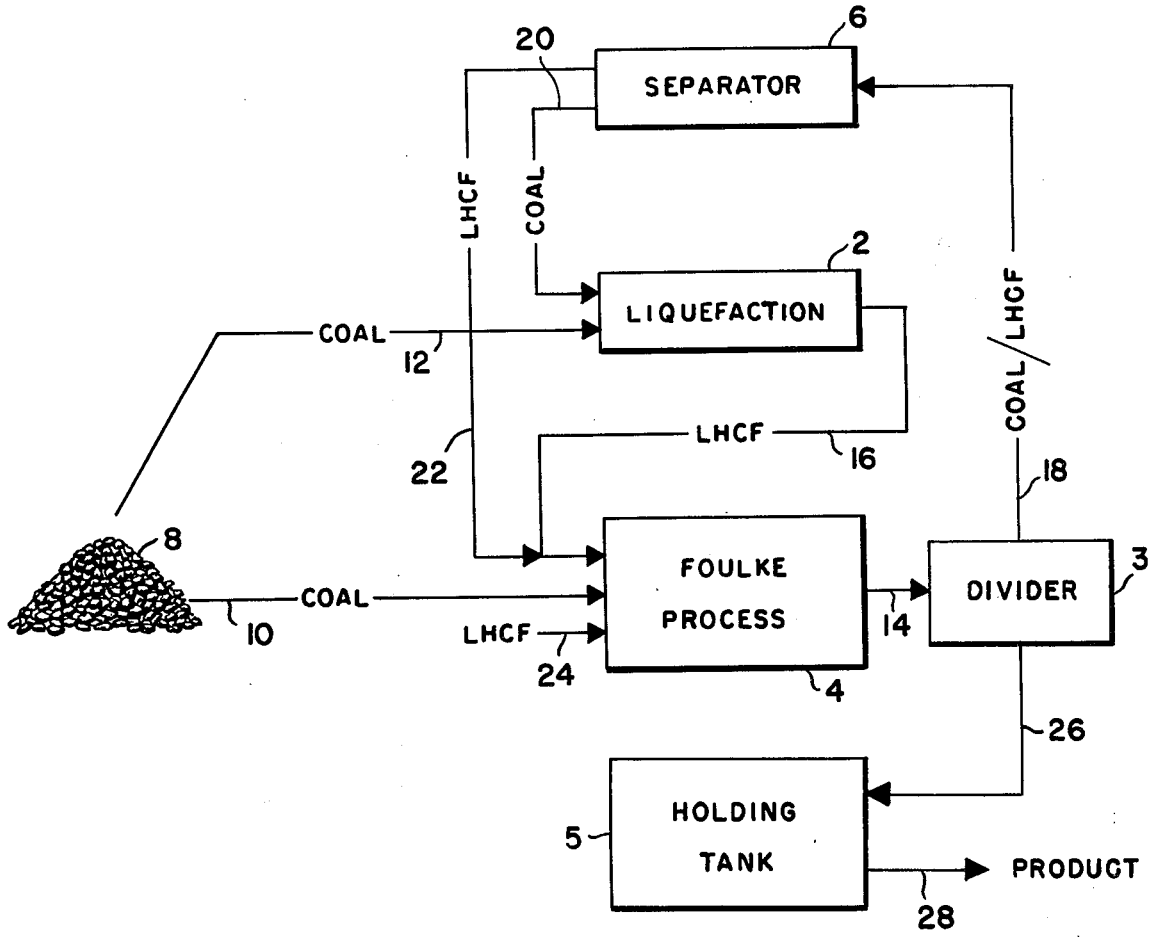
SEPARATOR
6
20
LHCF
COAL
LIQUEFACTION
2
COAL
12
COAL/LHCF
LHCF
16
22
18
8
FOULKE
PROCESS
DIVIDER
3
COAL
10
LHCF
24
14
4
26
HOLDING
TANK
5
PRODUCT
28

PRODUCING FLUID FUEL FROM COAL

BRIEF SUMMARY OF THE INVENTION

This invention relates to the production of fluid hydrocarbon fuels from coal and particularly to a method whereby known coal liquefaction processes are improved and made more productive from an economic standpoint.

A number of coal liquefaction processes have been proposed which are capable of producing liquid hydrocarbon fuel either as the principal product or as a co-product along with gas. Among the more well-known processes are: carbonization, hydrocarbonization, direct hydrogenation, solvent extraction, the Fischer-Tropsch catalytic process, and the treatment of coal with oil to effect liquefaction.

Carbonization is the distillation of coal in the absence of air. Liquid hydrocarbon fuels are among the fractions produced in the distillation process. Carbonization processes for coal liquefaction have been investigated for many years. An example of a more recent development in coal liquefaction by carbonization is the COED process, which produces synthetic crude oil by the pyrolysis of coal. The COED process utilizes a series of fluidized-bed reactors in which the coal to be treated is subjected to successively higher temperatures. Oil is produced by condensation of volatile products. The COED process as well as a number of other carbonization processes are described in Holmes, J. M. et al., *Evaluation of Coal Carbonization Processes* in Coal Processing Technology, Volume 3, pp. 40–46, American Institute of Chemical Engineers, 1977. Carbonization produces relatively small liquid yields, typically around thirty gallons of fuel oil per ton of coal.

Hydrocarbonization involves the distillation of coal in the presence of pressurized hydrogen used as a fluidizing medium. The distillate is condensed to produce various fractions, including liquid hydrocarbon fuels. Typically, the solid char produced in the distillation process is burned in oxygen and treated with steam to produce hydrogen, which is returned to the distillation process. An example of hydrocarbonization is found in the Coalcon process, described both in the Holmes et al. paper and in Ferretti, E. J. *Design Concept For A Coal Hydrocarbonization Plant* in Coal Processing Technology, Volume 3, pp. 138–139, A.I.Ch.E., 1977. It has been found that the presence of hydrogen tends to increase the yield of liquid, and the Coalcon process has been estimated as capable of producing approximately fifty-eight gallons of fuel oil per ton of coal.

Direct hydrogenation is carried out by forming a slurry of coal, and reacting it with hydrogen under high pressure, usually in the presence of a catalyst. Typically, the product of the hydrogen treatment is subjected to a distillation step wherein various fractions including hydrocarbon fuels are produced as well as a char which is gasified to produce process hydrogen. One such process, known as the H-Coal process, is described in Stotler, H. H., *The H-Coal Pilot Plant Program* in Coal Processing Technology, Volume 2, pp. 15–19, 1975.

Hydrogenation can also be accomplished by solvent extraction, in which hydrogenation takes place with the coal in a dissolved condition. According to one method of solvent extraction known as the "Exxon Donor Solvent Process" coal is dissolved in a hydrogen-rich solvent such as Tetralin, producing a product which can be separated into gas and liquid hydrocarbon fuels. Naphthalene, also separated from the product, is hydrogenated to produce more Tetralin with which to dissolve the coal. This process is described in Furlong, E. *The Exxon Donor Solvent Process* in Coal Processing Technology, Volume 3, pp. 145–151, A.I.Ch.E., 1977. Other versions of the extraction process include one in which the coal solution is treated with hydrogen.

According to the Fischer-Tropsch process, coal is burned in a gasifier in the presence of oxygen and steam to produce carbon monoxide and hydrogen. The gas produced in the gasifier is then passed through a fixed-bed catalytic converter to produce combustible gas and various liquid hydrocarbon fuels. The Fischer-Tropsch process is described in Cochran, M. P., *Oil And Gas From Coal,* Scientific American, May 1976, pp. 24–29.

Oil treatment of coal, another method of producing a liquid hydrocarbon fuel, is carried out by the addition of oil, and the application of high temperatures to effect solution of part of the coal. One such process, described in Espenscheid et al. U.S. Pat. No. 4,035,281 dated JUly 12, 1977, is carried out by admixing comminuted coal with petroleum fractions to form a slurry, heating the slurry to dissolve the coal, separating out ash and other undissolved solids, and finally blending the solution with light hydrocarbon oil to produce a blended product qualifying as a No. 5 fuel oil.

These and various other coal liquefaction processes have been carried out on a small scale and some have been commercialized to a limited extent. However, no coal liquefaction process has met with substantial success despite the highly developed technology evident from the above-cited publications. In some cases, it can be surmised that the need for extremely high pressures and other factors required prohibitively large capital expenditures. In addition, the efficiencies of the processes in some cases are believed to be so low as to make them uneconomical.

The principal object of this invention is to improve known coal liquefaction processes by making them more economical to build and operate, thereby making them practical for commercial use. This object is achieved in accordance with the invention by a process in which a quantity of coal is treated in the following manner. A portion of the quantity of coal is treated by one of the known liquefaction processes to produce a liquid hydrocarbon fuel and by-products including solid and gaseous products. The remainder of the quantity of coal is combined with the liquid hydrocarbon fuel to produce a fluid fuel product. To produce a product which is capable of flowing as a substantially homogeneous suspension, the portion of the coal which is combined with the liquid hydrocarbon is pulverized at any desired stage of the process. The product, which is in the form of a suspension of coal particles in a liquid hydrocarbon fuel can be burned directly, transported by pipeline, or otherwise transported, handled and used in much the same manner as the pure liquid hydrocarbon fuel. However the quantity of liquid hydrocarbon fuel in the product required to produce a given amount of heat energy is greatly reduced. Consequently the liquefaction equipment can be of a reduced size with a resultant reduction in the cost of the plant, and (in some cases) in the amount of energy expended in its operation.

In a preferred form of the invention, coal is combined with the liquid hydrocarbon fuel by means of the Foulke process and apparatus described in U.S. Pat. No.

3,932,145 dated Jan. 13, 1976. The disclosure of this patent is incorporated herein by reference. In accordance with the Foulke process, a low-sulfur fuel consisting essentially of coal particles suspended in an oil is produced by introducing raw coal, which consists of a mixture of coal particles and undesired particles (e.g. pyrite and other particulate matter) having a higher specific gravity than coal into a concentrator, introducing oil into the concentrator, cleaning the mixture in the concentrator using oil as the cleaning medium by effecting settling of the undesired particles, and removing from the concentrator a suspension of coal particles in oil for use as a fuel. The Foulke process has as one of its principal advantages the fact that it effects cleaning of the coal without the introduction of water, and in fact even removes some of the water which is inherently present in the coal. The elimination of water in the process greatly increases the available heat content of the fuel per unit weight. The Foulke process is incorporated into the present invention by utilizing the liquid hydrocarbon fuel generated by coal liquefaction as the cleaning medium for part or all of the raw coal upon which the process operates. Incorporation of the Foulke process in the present invention not only reduces sulfur content in the product but also gives rise to the possibility of recirculating a portion of the product to the liquefaction apparatus so that the material upon which the liquefaction apparatus operates has a reduced sulfur content.

Other objects and advantages will be apparent from the following detailed description when read in conjunction with the drawing.

BRIEF DESCRIPTION OF THE DRAWING

The single FIGURE is a schematic diagram illustrating a number of alternative processes in accordance with the invention.

DETAILED DESCRIPTION

As shown in the FIGURE, the apparatus used in carrying out the preferred process in accordance with the invention comprises liquefaction apparatus 2, divider 3, Foulke process equipment 4, holding tank 5 and a separator 6.

The liquefaction apparatus can be any apparatus capable of liquefying coal to convert all or part of the coal to a liquid hydrocarbon fuel. Carbonization, hydrocarbonization, direct hydrogenation, solvent extraction, the Fischer-Tropsch process, oil treatment, and equivalent processes can be used.

The Foulke apparatus, as set forth in U.S. Pat. No. 3,932,145, comprises, as its principal element, a concentrator, which is a device utilizing a liquid medium for separating solid particles having a lower specific gravity from those having a higher specific gravity by effecting settling of the latter, and carrying away the particles having a lower specific gravity in the liquid. The hindered settling concentrator, a device well known in the ore dressing art, is an example of a suitable concentrator. Oil and ground coal containing undesired particles are fed into the concentrator, and an upward flow of oil in the concentrator effects separation of the dense undesired particles from the less dense coal particles. A mixture of oil and comparatively clean coal particles is then removed from the concentrator as a suspension and used as a fuel. In the Foulke apparatus as used in the present invention, the cleaning medium is the liquid hydrocarbon fuel, and the product is a suspension of cleaned coal particles in the hydrocarbon fuel. Undesired material or "refuse" separated out by the Foulke process is disposed of in the same manner as described in the Foulke patent.

Divider 3 preferably comprises a small tank arranged to receive the suspension produced by the Foulke process and to deliver a part of the Foulke process output to holding tank 5 and another part to separator 6. The divider maintains a constant ratio between the flow rates to the separator and the holding tank, and is preferably controllable so that the ratio can be varied as desired. The ratio between the rates of delivery of the two outputs of the divider is determined by the settings of valves or of variable displacement or variable speed pumps controlling the delivery of suspension from the small tank to the separator and holding tank.

Separator 6 is a conventional centrifugal separator used to separate a portion of the Foulke process output into coal and oil. The coal is then fed back to the liquefaction apparatus, and the oil is fed back to the Foulke process.

The FIGURE shows a number of paths, but not all paths are necessarily used. Coal from a supply of raw or cleaned coal is delivered to the Foulke apparatus through a first path 10. A second path 12 is provided for the delivery of coal from supply 8 to liquefaction apparatus 2, which converts the coal to a liquid hydrocarbon fuel (LHCF). A mixture of coal and liquid hydrocarbon fuel is delivered from the Foulke process through a delivery path 14. Liquid hydrocarbon fuel is delivered from the output of liquefaction apparatus 2 through path 16 to the Foulke process. In addition, a path 18 is provided for delivery of part of the Foulke process output from divider 3 to separator 6. Coal is delivered from the output of the separator through path 20 to liquefaction apparatus 2, and liquid hydrocarbon fuel is returned to the Foulke process through path 22. A path 24 is provided for the delivery of liquid hydrocarbon fuel, obtained from a source other than liquefaction apparatus 2, to the Foulke process. The portion of the Foulke process output which is not recirculated through path 18 is delivered through path 26 to holding tank 5, from which the product, a suspension of coal in liquid hydrocarbon fuel, can be drawn through path 28.

The apparatus shown in the FIGURE can be operated in a number of modes, the principal modes being as follow.

In one relatively simple mode of operation, a portion of the quantity of coal in supply 8 is delivered through path 12 to liquefaction apparatus 2, and the remainder of the coal is delivered through path 10 to the Foulke apparatus. The liquid hydrocarbon fuel produced by liquefaction is delivered through path 16 to the Foulke apparatus. The Foulke apparatus is used here primarily for effecting mixing of the coal in path 10 with the liquid hydrocarbon fuel in path 16. However, the Foulke process also includes means for effecting pulverization of the coal in path 10 to a sufficiently small particle size to permit the product in path 14 to flow as a substantially homogeneous suspension. The Foulke process, of course, also effects cleaning of the coal by gravity separation so that the product produced is suitable for burning, even though the coal from supply 8 may be contaminated with large quantities of sulfur-containing materials. The division of the coal in supply 8 into two parts, and the admixture of the coal in path 10 with the liquefied product of the coal in path 12 results in a product at path 28 which is suitable for burning as a liquid, but eases the requirements placed on the liquefaction apparatus. This is especially significant where hydrogenation processes are used for liquefaction, as large capital expenditures and high energy requirements have made such plants uneconomical in many instances.

In another mode of operation, a portion of the product in path 14 is delivered through path 18 to separator 6, wherein the coal and liquid hydrocarbon fuel in the product are at least partially separated from each other. Coal is delivered through path 20 to liquefaction apparatus 2, and liquid hydrocarbon fuel is delivered through path 22 to Foulke apparatus 4, where it is reused as a coal cleaning medium.

Separation by centrifugal equipment is not perfect; some coal particles will be present in path 22, and some liquid hydrocarbon fuel will be present in path 20. However, the nature of the apparatus is such that perfect separation is not needed. Oil in path 20 has no adverse effect on the operation of the liquefaction apparatus, and coal in path 22 likewise has no adverse effect on the operation of the Foulke process.

In this more detailed mode of operation, paths 12, 22 and 24 are optional. Liquefaction apparatus 2 can operate entirely on coal cleaned by the Foulke process and delivered through path 20 from the separator. In this mode of operation, start-up of the apparatus requires an initial production of liquid hydrocarbon fuel by the direct delivery of coal through path 12 to the liquefaction apparatus, or alternatively the delivery of liquid hydrocarbon fuel from an auxiliary source to the Foulke process through path 24. As soon as the separator begins to deliver coal through path 20, paths 12 and 24 can be cut off so that the apparatus runs entirely on liquid hydrocarbon fuel produced by liquefaction.

As a further alternative, the liquefaction apparatus can receive coal through paths 12 and 20 simultaneously. Similarly, the Foulke process can be supplied with liquid hydrocarbon fuel through paths 16 and 24 simultaneously.

Path 22, which delivers liquid hydrocarbon fuel from the separator to the Foulke process provides a convenient drain for the liquid hydrocarbon fuel output of the separator, but need not be used, particularly if other uses for the liquid output of the separator are found. For example, the liquid can be burned to provide process heat for operation of the liquefaction apparatus or for operation of the Foulke process.

Where the liquefaction apparatus is capable of operating on a suspension of coal in liquid hydrocarbon fuel, the separator can be eliminated, in which event the liquefaction apparatus operates directly on the suspension in path 18.

It should also be noted that a number of available liquefaction processes produce gas. This, also, can be sold or burned to produce process heat.

While the principal contemplated modes of operation have been described, it will be apparent that numerous variations can be made in the proportions of coal and liquid hydrocarbon fuel delivered through the various paths. Other possible variations of the process include the addition of combustible solids such as solid by-products (e.g. char) of coal liquefaction to the liquefaction product in order to produce a combustible suspension.

The recirculation of a portion of the product through path 18 has as its principal advantage the fact that it supplies a quantity of relatively clean coal to the liquefaction apparatus while requiring very little in the way of equipment beyond the liquefaction apparatus and Foulke apparatus already present. The cleaner coal delivered to the liquefaction apparatus through path 20 results in a cleaner liquid hydrocarbon fuel in path 16, with the result that the sulfur content in the product in path 28 is reduced.

Recirculation paths 18 and 20, when used, also provide a degree of self-regulation in that an increase in the quantity of coal entering the Foulke process through path 10 results in an increase in the quantity of liquid hydrocarbon fuel entering the Foulke process through path 16. If, for example, the concentration of coal in the output of the Foulke process at path 14 increases, the portion sent to the separator through path 18 contains more coal with the result that more coal is fed to the liquefaction apparatus. This results in an increase in the output of the liquefaction apparatus, and therefore the rate at which liquid is fed to the Foulke process increases. This increase in liquid fed to the Foulke process decreases the concentration of the Foulke process output in path 14. Because the liquefaction apparatus does not respond immediately to changes in the rate of feed of coal in path 20, the concentration of coal in path 14 may tend to fluctuate up and down. However the fluctuations at product path 28 can be reduced and even substantially eliminated by making holding tank 5 sufficiently large to take into account the inherent delays in operation of the liquefaction apparatus. The concentration of the product at path 28 is ultimately determined by the setting of divider 3, which may be varied to produce a wide range of coal particle concentrations (e.g. up to more than 70% coal by weight in the product for some grades of coal).

If the liquid output of the liquefaction apparatus in path 16 is not closely proportional to the rate at which coal is fed to its input through path 20, the coal concentration at path 26 may change somewhat with variations in the rate of feed of coal in path 10. To the extent that the self-regulation of the system arising by virtue of recirculation paths 18 and 20 is insufficient to provide complete control of product concentration, further control can be achieved by manual operation of divider 3 to change the proportioning between paths 18 and 26.

The product of the process described herein can be burned where it is produced for power generation or to produce heat for various industrial processes. Alternatively, the product can be transported by pipeline or in tank cars for burning at remote locations.

I claim:

1. A process for producing a fluid fuel from a quantity of coal comprising the steps of:

treating a portion of said quantity of coal to produce a liquid hydrocarbon fuel; and combining the remainder of said quantity of coal with said liquid hydrocarbon fuel to produce a product;

the process also including the step of reducing said remainder to a sufficiently small particle size to permit said product to flow as a suspension;

in which said remainder of said quantity of coal is combined with said liquid hydrocarbon fuel by introducing both said liquid hydrocarbon fuel and said remainder into a concentrator, cleaning said remainder in the concentrator using said liquid hydrocarbon fuel as a cleaning medium, by effecting settling of undesired particles, and removing from the concentrator a suspension of coal particles in said liquid hydrocarbon fuel as the product; and in which at least a portion of said product is treated to separate coal therefrom, and at least part of the coal thus separated from said product is combined with said portion of said quantity of coal and treated along with said portion of said quantity of coal to form said liquid hydrocarbon fuel.

2. A process according to claim 1 in which at least a portion of said product is treated to separate liquid hydrocarbon fuel therefrom and at least part of the fuel thus separated from said product is returned to said concentrator.

3. A process for producing a fluid fuel from a quantity of coal comprising the steps of:

treating a portion of said quantity of coal to produce a liquid hydrocarbon fuel; and combining the remainder of said quantity of coal with said liquid hydrocarbon fuel to produce a product;

the process also including the step of reducing said remainder to a sufficiently small particle size to permit said product to flow as a suspension;

in which said remainder of said quantity of coal is combined with said liquid hydrocarbon fuel by introducing both said liquid hydrocarbon fuel and said remainder into a concentrator, cleaning said remainder in the concentrator using said liquid hydrocarbon fuel as a cleaning medium, by effecting settling of undesired particles, and removing from the concentrator a suspension of coal particles in said liquid hydrocarbon fuel as the product; and in which said portion of said quantity of coal is derived by treatment of at least a portion of said product to separate coal therefrom.

4. A process according to claim 1 in which liquid hydrocarbon fuel is also separated from at least a portion of said product and returned to said concentrator.

5. A process for producing a fluid fuel from a quantity of coal comprising the steps of:

treating a portion of said quantity of coal to produce a liquid hydrocarbon fuel; and combining the remainder of said quantity of coal with said liquid hydrocarbon fuel to produce a product;

the process also including the step of reducing said remainder to a sufficiently small particle size to permit said product to flow as a suspension;

in which said remainder of said quantity of coal is combined with said liquid hydrocarbon fuel by introducing both said liquid hydrocarbon fuel and said remainder into a concentrator, cleaning said remainder in the concentrator using said liquid hydrocarbon fuel as a cleaning medium, by effecting settling of undesired particles, and removing from the concentrator a suspension of coal particles in said liquid hydrocarbon fuel as the product; and in which at least part of the liquid hydrocarbon fuel introduced into the concentrator is derived by liquefaction of coal derived from the suspension removed from the concentrator.

6. A process according to claim 1 in which at least part of the remainder of the suspension removed from the concentrator is delivered to a temporary holding vessel.

* * * * *

UNITED STATES PATENT AND TRADEMARK OFFICE

CERTIFICATE OF CORRECTION

PATENT NO. : 4,159,897

DATED : July 3, 1979

INVENTOR(S) : David H. Doehlert

It is certified that error appears in the above-identified patent and that said Letters Patent are hereby corrected as shown below:

Column 2, line 21, "JUly" should read --July--.

Column 4, line 47, "follow" should read --follows--.

Column 8, line 1, "claim 1" should read --claim 3--.

Column 8, line 26, "claim 1" should read --claim 5--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*